US010352118B2

(12) United States Patent
Jerez et al.

(10) Patent No.: US 10,352,118 B2
(45) Date of Patent: Jul. 16, 2019

(54) LATCHABLE CASING WHILE DRILLING SYSTEMS AND METHODS

(71) Applicant: HALLIBURTON ENERGY SERVICES, INC., Houston, TX (US)

(72) Inventors: Hernando Q. Jerez, The Woodlands, TX (US); Richard T. Hay, Spring, TX (US); John G. Evans, The Woodlands, TX (US); Rohit Sankeshwari, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 225 days.

(21) Appl. No.: 15/516,659

(22) PCT Filed: Dec. 23, 2014

(86) PCT No.: PCT/US2014/072148

§ 371 (c)(1),
(2) Date: Apr. 3, 2017

(87) PCT Pub. No.: WO2016/073016

PCT Pub. Date: May 12, 2016

(65) Prior Publication Data

US 2017/0247964 A1 Aug. 31, 2017

Related U.S. Application Data

(60) Provisional application No. 62/074,802, filed on Nov. 4, 2014.

(51) Int. Cl.

| | |
|---|---|
| ***E21B 23/03*** | (2006.01) |
| ***E21B 10/32*** | (2006.01) |
| ***E21B 7/28*** | (2006.01) |
| ***E21B 33/00*** | (2006.01) |
| ***E21B 33/14*** | (2006.01) |
| ***E21B 7/20*** | (2006.01) |

(Continued)

(52) U.S. Cl.
CPC ..... *E21B 23/03* (2013.01); *E21B 7/04* (2013.01); *E21B 7/203* (2013.01); *E21B 7/28* (2013.01);

(Continued)

(58) Field of Classification Search
CPC ..... E21B 23/03; E21B 10/32; E21B 34/06; E21B 17/006; E21B 7/04; E21B 23/02;

(Continued)

(56) References Cited

U.S. PATENT DOCUMENTS 5,197,553 A 3/1993 Leturno
5,271,472 A * 12/1993 Leturno ..... E21B 7/208 175/107

(Continued)

FOREIGN PATENT DOCUMENTS

RU 2260666 C1 9/2005
RU 2287654 C2 11/2006

(Continued)

OTHER PUBLICATIONS

PCT International Search Report and Written Opinion, dated Aug. 25, 2015, Appl No. PCT/US2014/072148, "Latchable Casing While Drilling Systems and Methods," Filed Dec. 23, 2014, 13 pgs.

*Primary Examiner* — George S Gray
(74) *Attorney, Agent, or Firm* — Alan Bryson; Parker Justiss, P.C.

(57) ABSTRACT

Latchable casing while drilling systems and methods are disclosed. Some system embodiments include a casing string including an upper latch apparatus and a lower latch apparatus. The system also includes a bottom hole assembly (BHA) latched into the lower latch apparatus for steerable drilling, the BHA configured to latch into the upper latch apparatus for enlarging a rat hole.

20 Claims, 10 Drawing Sheets

(51) Int. Cl.

| | |
|---|---|
| ***E21B 23/02*** | (2006.01) |
| ***E21B 33/13*** | (2006.01) |
| ***E21B 33/16*** | (2006.01) |
| ***E21B 7/04*** | (2006.01) |
| ***E21B 17/00*** | (2006.01) |
| ***E21B 34/06*** | (2006.01) |

(52) U.S. Cl.
CPC ..... *E21B 10/32* (2013.01); *E21B 17/006* (2013.01); *E21B 23/02* (2013.01); *E21B 33/13* (2013.01); *E21B 33/14* (2013.01); *E21B 33/16* (2013.01); *E21B 34/06* (2013.01); *E21B 7/20* (2013.01); *E21B 33/00* (2013.01)

(58) Field of Classification Search
CPC . E21B 7/28; E21B 7/203; E21B 33/16; E21B 33/14; E21B 33/13; E21B 7/20; E21B 33/00
See application file for complete search history.

(56) References Cited

U.S. PATENT DOCUMENTS

| | | | | |
|---|---|---|---|---|
| 5,579,829 | A * | 12/1996 | Comeau | E21B 7/061 166/117.6 |
| 5,842,517 | A | 12/1998 | Coone | |
| 7,311,148 | B2 * | 12/2007 | Giroux | E21B 4/02 166/177.4 |
| 7,325,617 | B2 * | 2/2008 | Murray | E21B 23/02 166/153 |
| 7,604,057 | B1 | 10/2009 | Eriksen et al. | |
| 7,784,552 | B2 | 8/2010 | Brouse | |
| 7,861,781 | B2 | 1/2011 | D'Arcy | |
| 8,371,398 | B2 | 2/2013 | Miller et al. | |
| 8,439,113 | B2 | 5/2013 | Boyle | |
| 8,899,336 | B2 | 12/2014 | Giroux et al. | |
| 2002/0020531 | A1 | 2/2002 | Ohmer | |
| 2010/0147517 | A1 * | 6/2010 | D'Arcy | E21B 33/16 166/291 |
| 2012/0168178 | A1 | 7/2012 | Eriksen et al. | |
| 2014/0034310 | A1 * | 2/2014 | Andersen | E21B 34/14 166/281 |
| 2014/0041881 | A1 * | 2/2014 | Dirksen | E21B 23/00 166/382 |
| 2014/0054036 | A1 | 2/2014 | Regener et al. | |

FOREIGN PATENT DOCUMENTS

| | | | |
|---|---|---|---|
| RU | 2437999 | C1 | 12/2011 |
| SU | 381754 | A1 | 5/1973 |
| SU | 898036 | A | 1/1982 |
| WO | 2012/134705 | | 5/2009 |

* cited by examiner

LATCHABLE CASING WHILE DRILLING SYSTEMS AND METHODS

BACKGROUND

Oilfield operators perform a series of operations to obtain a producing well including drilling a borehole, inserting casing, and cementing the casing in place. These operations generally require operators to conduct multiple insertions and removals ("trips") of the bottomhole assembly (BHA). Each additional trip requires an additional investment of time and resources.

Moreover, this sequential approach to constructing a well may face additional problems, e.g., in mature fields where formation pressure depletion causes increased challenges such as hole instability, lost circulation zones, salt creeping, and stuck pipe events. Unsurprisingly, mature fields routinely generate the highest amounts of non-productive time (NPT) during the drilling process, in many cases rendering access to the remaining reserves economically infeasible. The sequential approach may also be inadequate to the challenges created by a customer's field development plans having complex well trajectories with narrow mud windows through unstable formations.

BRIEF DESCRIPTION OF THE DRAWINGS

Accordingly, there are disclosed herein certain latchable casing while drilling (CWD) systems and methods. In the following detailed description of the various disclosed embodiments, reference will be made to the accompanying drawings in which.

Figure 1:
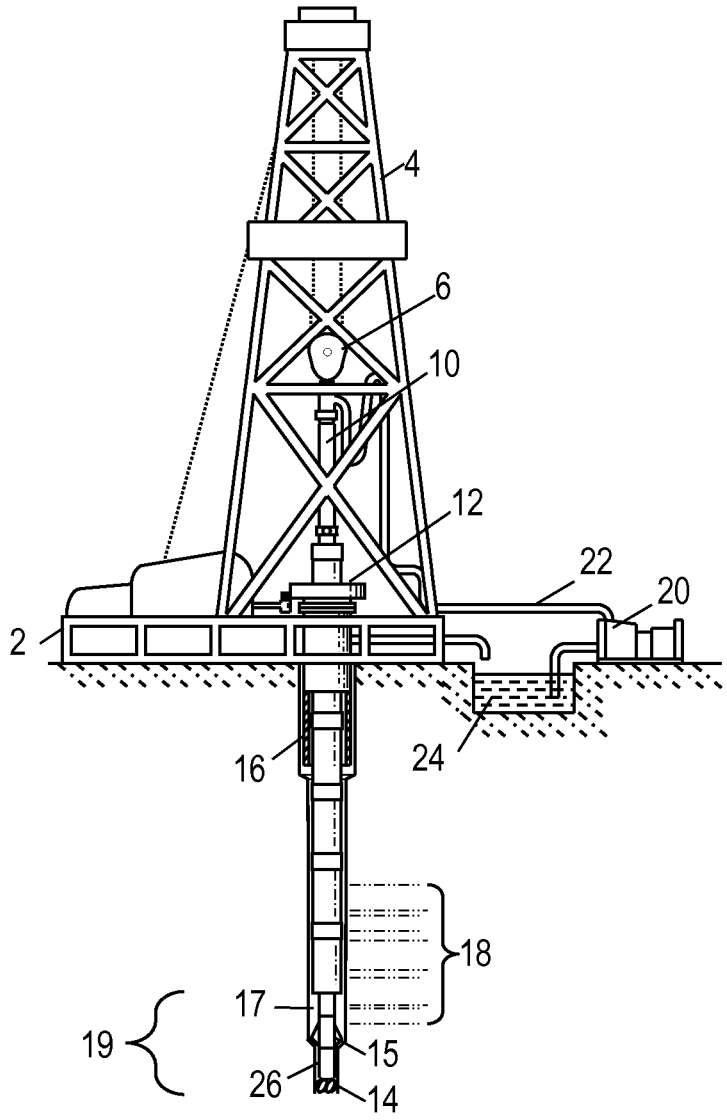
FIG. 1 is contextual view of an illustrative latchable CWD system.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

NOTATION AND NOMENCLATURE

Certain terms are used throughout the following description and claims to refer to particular system components and configurations. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or a direct electrical connection. Thus, if a first device couples to a second device, that connection may be through a direct electrical connection, or through an indirect electrical connection via other devices and connections. In addition, the term "attached" is intended to mean either an indirect or a direct physical connection. Thus, if a first device attaches to a second device, that connection may be through a direct physical connection, or through an indirect physical connection via other devices and connections.

DETAILED DESCRIPTION

The issues identified in the background are at least partly addressed by systems and methods for latchable casing while drilling. The disclosed systems and methods are best understood in the context of the environment in which they operate. Accordingly, FIG. 1 shows an illustrative drilling environment. A drilling platform 2 supports a derrick 4 having a traveling block 6 for raising and lowering a bottomhole assembly (BHA) 19. The platform 2 may also be located offshore for subsea drilling purposes in at least one embodiment. The BHA 19 may include one or more of a rotary steerable system, logging while drilling system, drill bit 14, reamer 15, and downhole motor 26. A top drive 10 supports and rotates the BHA 19 as it is lowered through the wellhead 12. The drill bit 14 and reamer 15 may also be driven by the downhole motor 26. As the drill bit 14 and reamer 15 rotate, they create a borehole 17 that passes through various formations 18. The reamer 15 may be an underreamer, a winged reamer, or the like, and the reamer 15 has extendable cutters that, when extended, enlarge the borehole to accommodate the casing 16. The cutters can be retracted to enable the drilling assembly to pass through the interior of the casing at a later stage.

A pump 20 circulates drilling fluid 24 through a feed pipe 22, through the interior of the drill string to the drill bit 14. The fluid exits through orifices in the drill bit 14 and flows upward to transport drill cuttings to the surface where the fluid is filtered and recirculated.

Figure 2:
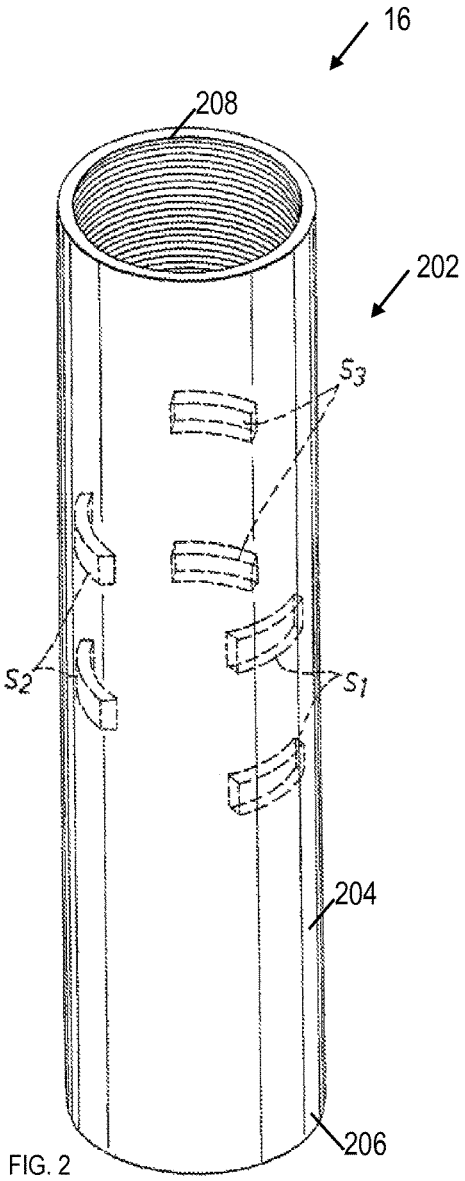
FIG. 2 is an isometric view of an illustrative latch apparatus.

FIG. 2 illustrates a portion of the casing 16 including a latch apparatus 202 that may be used during the drilling operations illustrated in FIG. 1. The latch apparatus 202 includes a tubular member 204 with two ends 206, 208 that may be coupled to other portions of the casing 16 via the mating of grooves or threads thus making the latch apparatus 202 part of the casing string, and the latch apparatus 202 may be made of any suitable casing material. The latch apparatus 202 also includes latch landings S1, S2, S3.

A latch landing, e.g. S1, may include one or more specially configured recesses formed along the interior surface of the latch apparatus 202 that are designed to align with and receive movable, spring loaded, latches extending radially from one or more downhole tools such as the BHA 19 and cement valves. For example, as illustrated, latch landing S1 includes two vertically-spaced recesses. The vertical spacing between recesses may be unique to prevent latches designed for other latch landings, e.g. latches designed for S2, from engaging with a particular latch landing, e.g. S1. In at least one embodiment, a unique horizontal spacing may be used for similar reasons. When the latches are properly aligned with the appropriate latch landing in the latch apparatus 202, the spring loading on the latches forces the latches to move radially outwardly into the recesses. When successfully engaged, the latches and latch landings anchor the downhole tool (e.g. BHA 19 or cement valves) to the casing 16.

The latch apparatus 202 may include more than one latch landing, e.g. S1, S2, S3. Each latch landing S1, S2, S3 may have a unique position and spacing between recesses relative to any other latch landing S1, S2, S3. As such, each latch landing S1, S2, S3 may be unique to a particular downhole tool or set of downhole tools with corresponding latches.

A downhole tool such as a BHA 19 may be moved past any set of latch landings S1, S2, S3 without engaging the latch landings S1, S2, S3 by rotating the downhole tool so that the latches are not aligned with corresponding latch landings S1, S2, S3 as they traverse the latch apparatus 202. Similarly, the casing 16 including the latch landings S1, S2, S3 may be prevented from engaging any downhole tool by rotating the casing so that the latch landings S1, S2, S3 are not aligned with corresponding latches as they traverse the downhole tool. For clarity, the BHA 19 will be used as an example. However, an inner casing string or other downhole tool may be used in various embodiments.

When the BHA 19 has been engaged with the latch apparatus 202, a non-rotational upward force on the BHA 19 (or converse downward force on the casing 16) causes release of the BHA 19 from the latch apparatus 202. The upward movement of the BHA 19 may be permitted by tapered upper shoulders between latches on the BHA 19 and the latch landings S1, S2, S3. While engaged, downward movement of the BHA 19 (or upward movement of the casing 16) may be prevented by square lower shoulders between latches on the BHA 19 and the latch landings S1, S2, S3. The amount of force required to release the BHA 19 may be altered as desired by adjusting the spring tension acting to extend the latches outward or by altering the surface contact areas between the latches and latch landings S1, S2, S3. For clarity, further embodiments will be described with two latch apparatuses 202. However, any number of axially-separated latch apparatuses 202 may be included in the casing 16 for greater flexibility in positioning the casing 16 and downhole tool to decrease the number of trips.

Figure 3A:
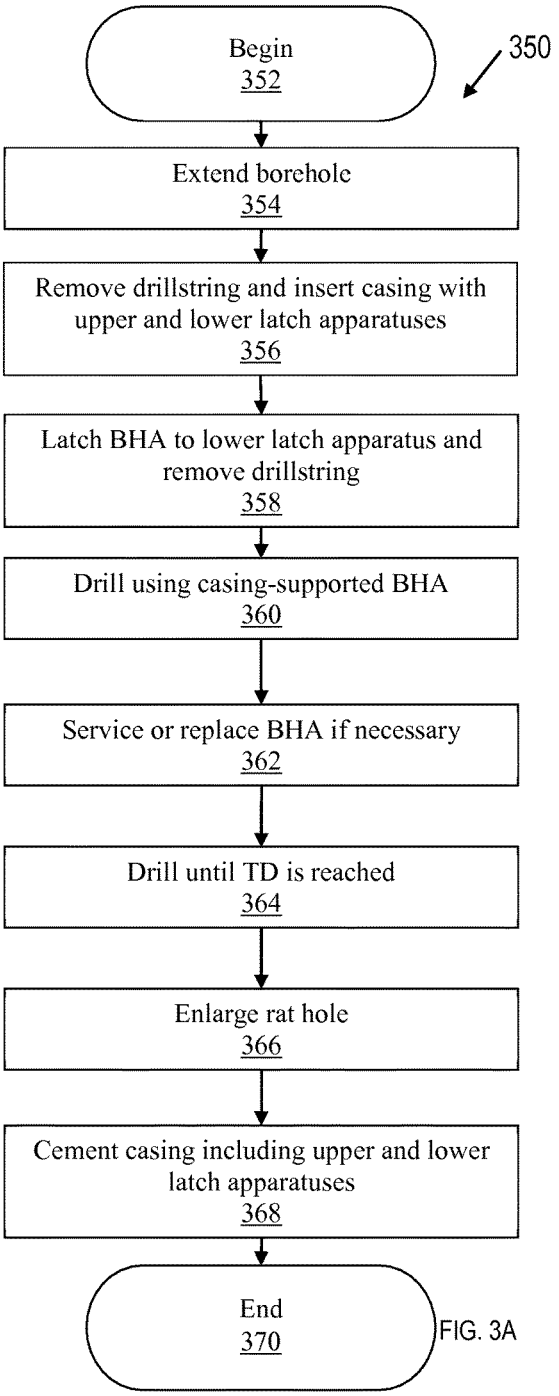
FIG. 3A is a flow chart illustrating a latchable CWD method.
Figure 3B:
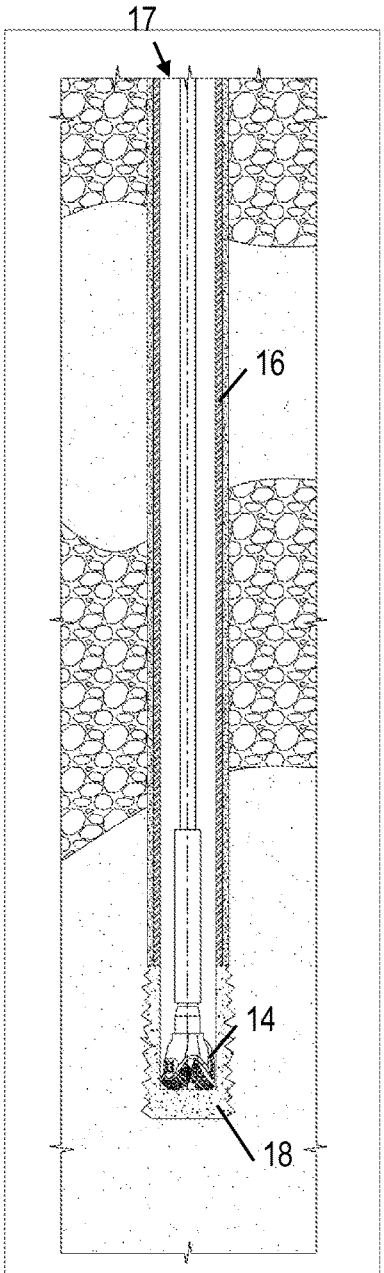
FIGS. 3B-3I are cross-sectional views of an illustrative multi-position latchable CWD system during a re-positioning operation.

FIGS. 3A-3I illustrate a method 350 of casing while drilling using two latch apparatuses in accordance with at least one embodiment. FIG. 3A is a flowchart beginning at 352 and ending at 370, and FIGS. 3B-3I are cross-sectional views of the borehole 17, which will be discussed in parallel with FIG. 3A. At 354 and FIG. 3B, a borehole 17 is extended past casing 16 that has been previously cemented. The borehole 17 may be extended by using the drill bit 14 to drill through the formation 18 below the cemented casing 16 as described above.

Figure 3C:
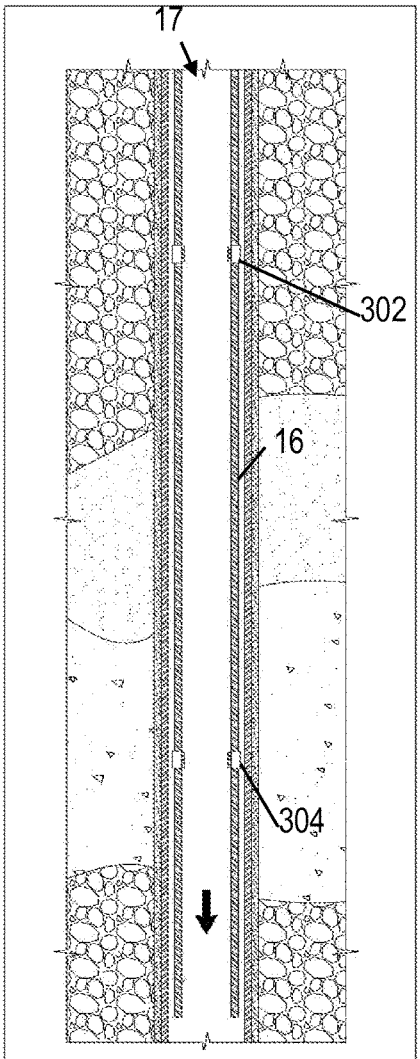

At 356 and FIG. 3C, the drillstring and BHA are removed from the borehole 17, and a section of casing 16 including an upper latch apparatus 302 and a lower latch apparatus 304 is inserted into the borehole 17. The casing 16 may include any number of latch apparatuses in various embodiments. The casing 16 may be assembled before insertion by coupling the lower latch apparatus 304 to one or more sections of casing at both ends. Next, the upper latch apparatus 302 may be coupled to the casing string. The distance between the upper 302 and lower 304 latch apparatus may be approximately the length of the BHA. The distance may also be such that the drill bit and reamer stick out past the bottom of the casing 16 when the BHA is engaged with the upper 302 or lower 304 latch apparatus in various embodiments.

Figure 3D:
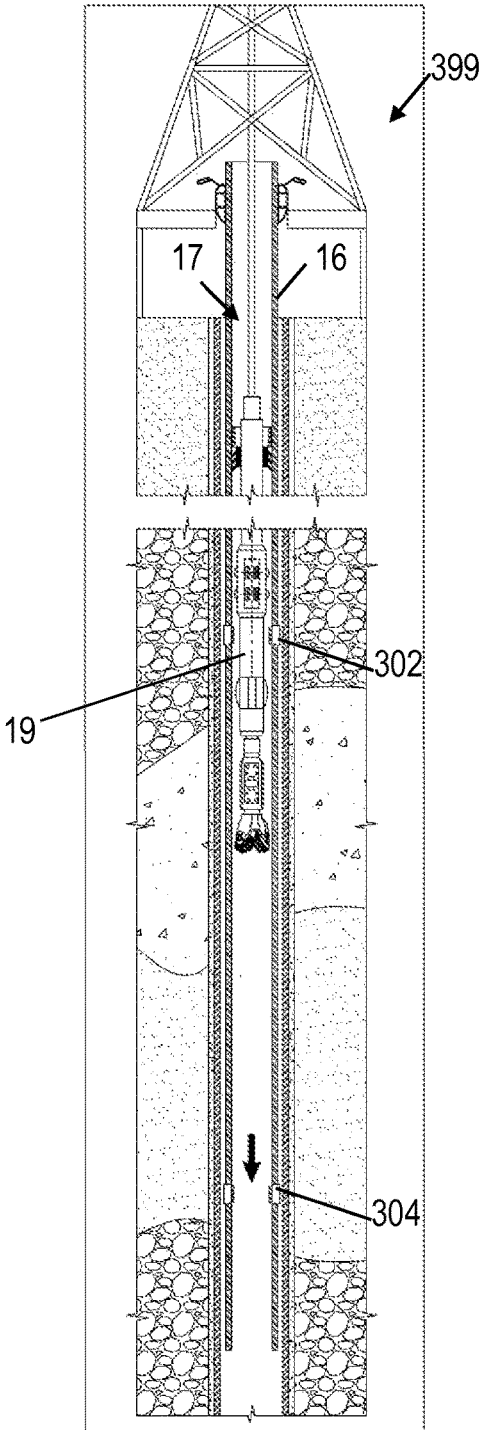
Figure 3E:
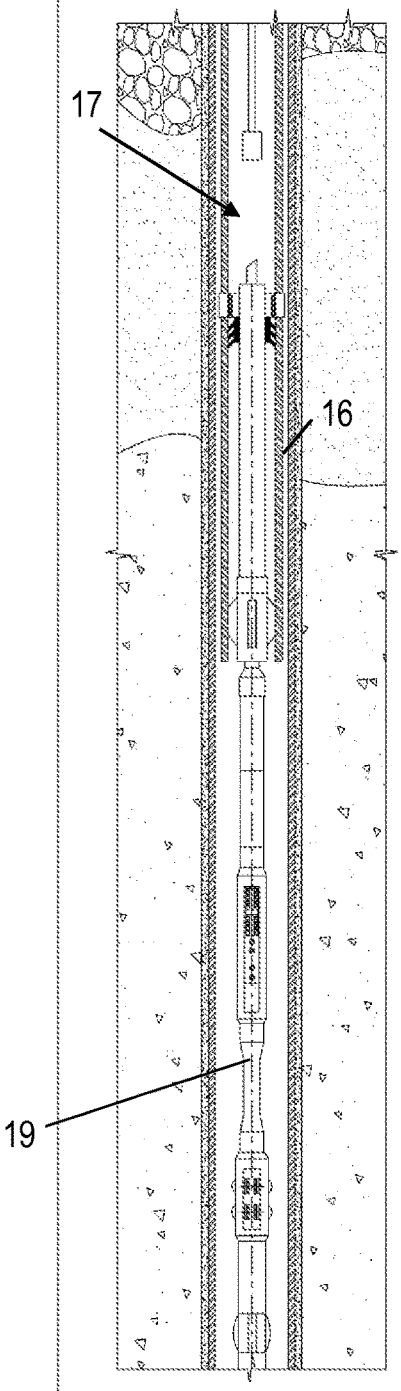

At 358 and FIG. 3D, the inserted casing 16 may be secured within casing slips 399. Next, the BHA 19 is assembled, inserted into the borehole 17, moved past the upper latch apparatus 302, and latched to the lower latch apparatus 304 as described above. Next as shown in FIG. 3E, with the BHA 19 secured and supported by the casing 16, the drillstring or wireline used to lower the BHA 19 into the borehole 17 is uncoupled from the BHA 19 and removed from the borehole 17. If desired, more sections of casing may be added to the top of the casing string.

Figure 3F:
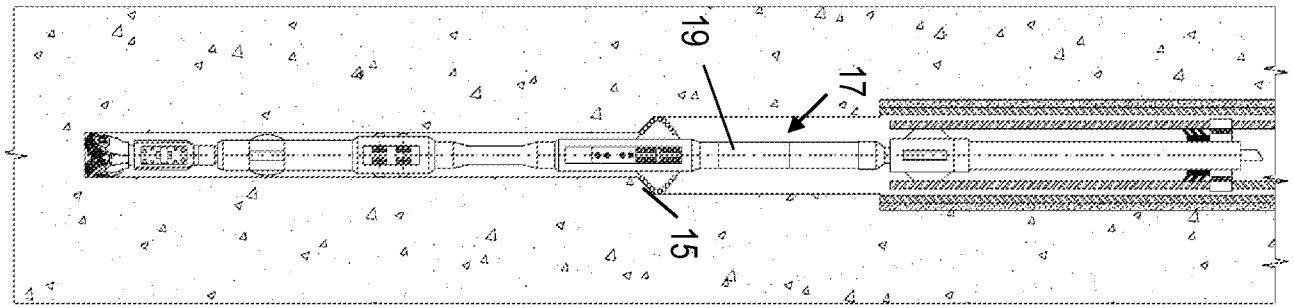

At 360 and FIG. 3F, the borehole 17 is extended using the casing-supported BHA 19. If desired, the reamer 15 may be extended and activated when clear of the previously cemented casing. The borehole 17 may be extended until total depth (TD) is reached, or the BHA 19 may be serviced or replaced before TD is reached if necessary.

Figure 3G:
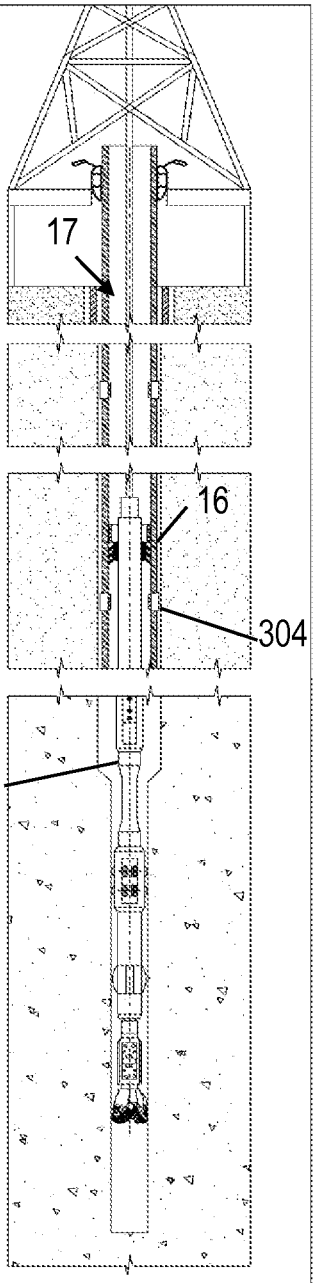
Figure 3H:
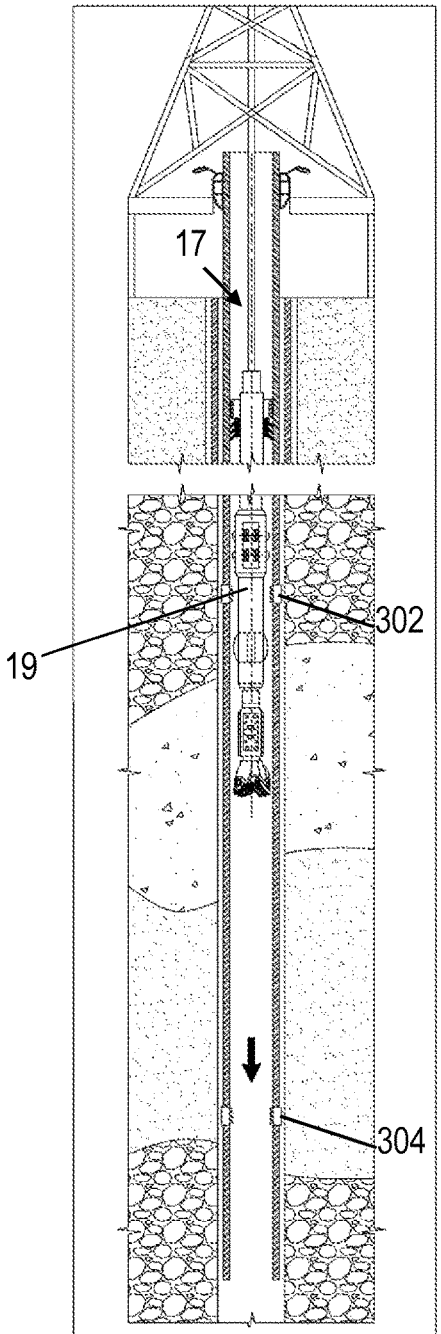

At 362 and FIGS. 3G-3H, the BHA 19 may be serviced or replaced in at least one embodiment. Turning to FIG. 3G, a drillstring or wireline may be coupled to the BHA 19 and used to unlatch the BHA 19 from the casing 16, specifically the lower latch apparatus 304, as described above. Next, the BHA 19 may be removed from the borehole 17 for servicing or replacement. Turning to FIG. 3H, the serviced or replacement BHA 19 is inserted into the borehole 17 via drillstring or wireline, moved past the upper latch apparatus 302, and latched to the lower latch apparatus 304.

A sealing assembly may also be implemented. For example, packer cups may circulate down throughout the bore of the BHA 19 and drill bit. When the BHA 19 is retrieved with drillpipe, the drillstring may include a packer, in case of a well kick, able to close the annulus between the retrieval string and the casing. The packer may be a full-opening, hookwall packer used for testing, treating, and squeeze cementing operations. The packer body may include a J-slot mechanism, mechanical slips, packer elements, and hydraulic slips. Large, heavy-duty slips in the hydraulic hold-down mechanism help prevent the packer from being pumped up the hole.

Figure 3I:
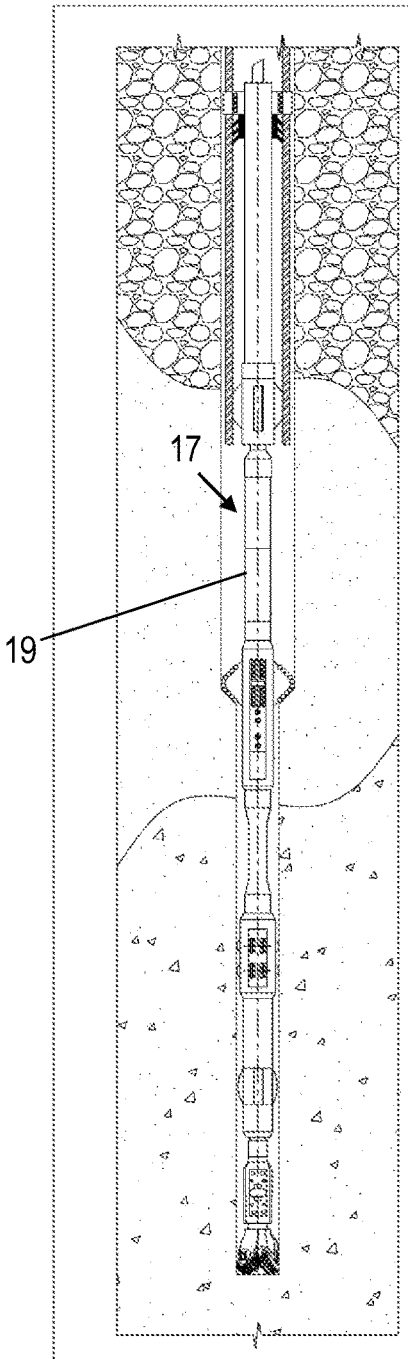

At 364 and FIG. 3I, the drillstring or wireline may be uncoupled from the BHA 19, and the borehole 17 may be extended until TD is reached by the casing-supported BHA 19. At 366, the rat hole is enlarged as explained with reference to FIGS. 4A-7B, and at 368, cementing is performed as explained with reference to FIGS. 8A-8C.

Figures 4A, 4B:
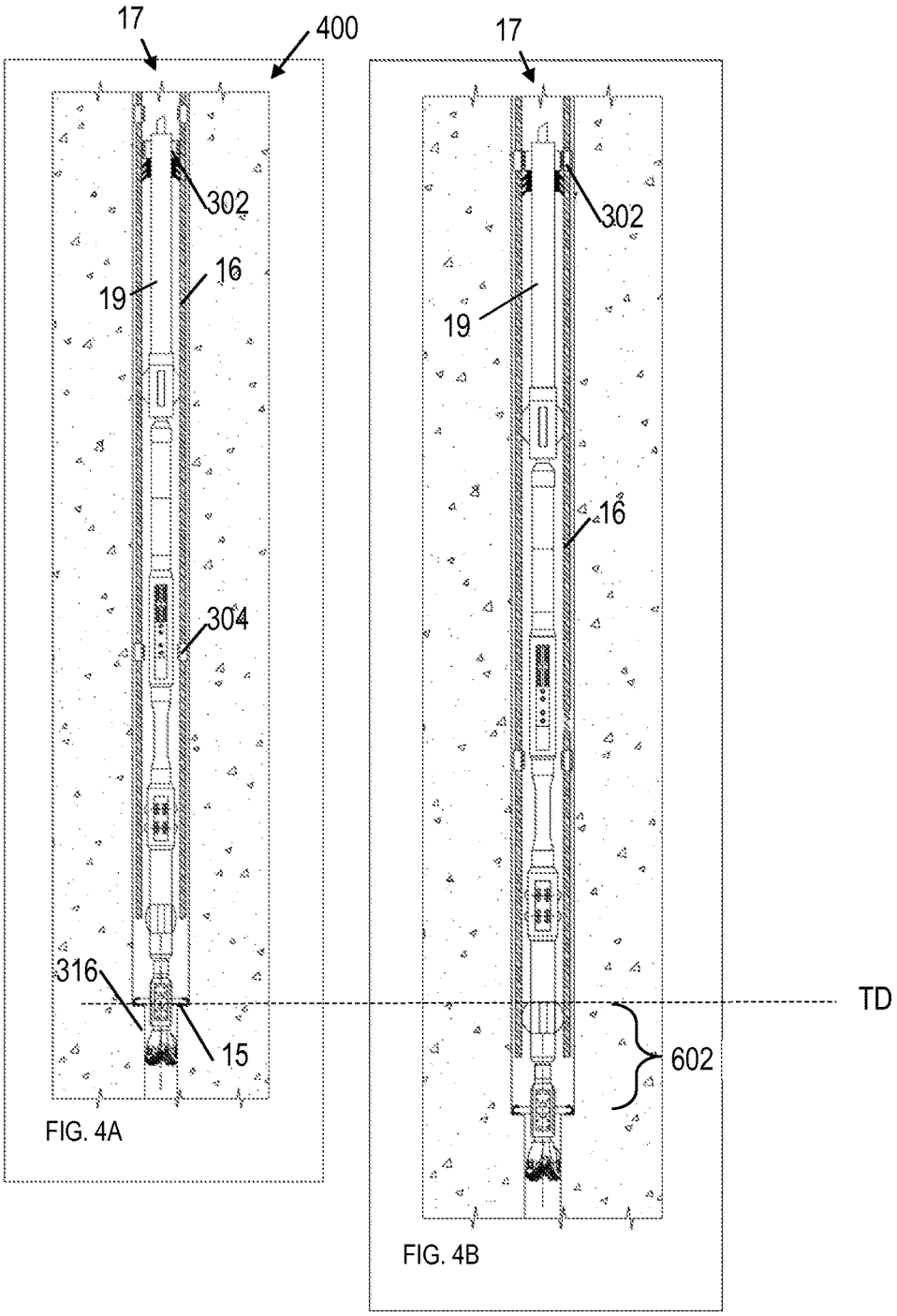
FIGS. 4A-4B are cross-sectional views of an illustrative multi-position latchable CWD system showing resting within the borehole.

Turning to FIG. 4A, a system 400 and method for enlarging a rat hole 316 using latching with casing and resting within the borehole are disclosed. First, the borehole 17 is drilled to the desired final depth, or total depth (TD). The rat hole 316 is the hole below the TD that has a smaller diameter than the casing 16. Next, the BHA 19 is repositioned such that the BHA reamer arms rest within the large-diameter portion of the borehole 17. As illustrated, resting the BHA 19 includes resting an extended reamer 15 of the BHA 19 on a top edge of the rat hole 316. Next, the casing 16 is moved relative to the resting BHA 19. For example, if the casing is engaged with the BHA at the lower latch apparatus 304, then moving the casing downward may disengage the BHA 19. Further downward movement of the casing 16, and rotation of the casing 16 if necessary, may cause the casing 16 to engage with the BHA 19 at the upper latch apparatus 302.

Next, turning to FIG. 4B, the rat hole 316 may be enlarged at the TD by drilling and reaming such that an area 602 underneath the TD is the close to the circumference of the borehole 17 rather than the circumference of the un-enlarged rat hole 316. The enlargement of the rat hole 316 may be performed while the BHA 19 is engaged with the upper latch apparatus 302. By enlarging the rat hole 316, the casing 16 may be positioned below the TD during the cementing process rather than as much as 100 feet above the TD. As such, the integrity of the surrounding earth formation may be increased.

Figure 5:
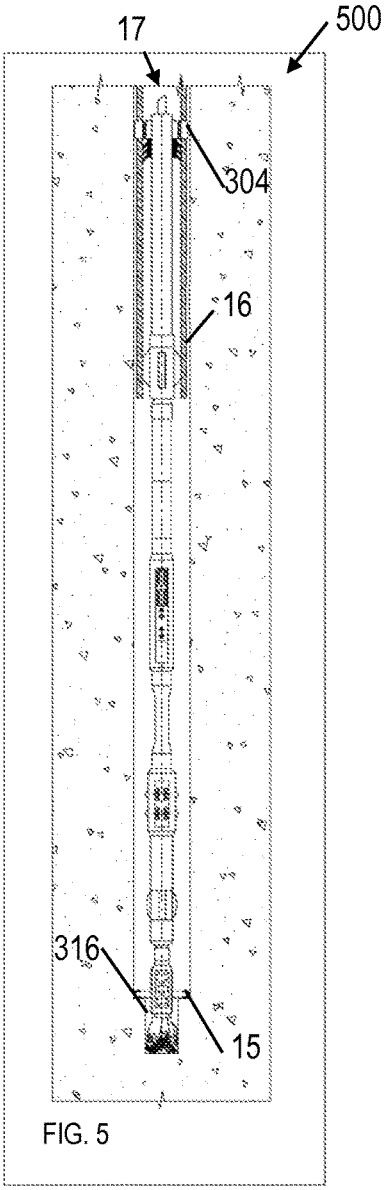
FIG. 5 is a cross-sectional view of an illustrative multi-position latchable CWD system showing drilling while using a lower latch apparatus.

Turning to FIG. 5, an alternative system 500 and method for enlarging a rat hole 316 using latching with casing and the lower latch apparatus are disclosed. First, the BHA 19 remains engaged with the lower latch apparatus 304. Next, the reamer 15 is activated to enlarge the rat hole 316 such that the circumference of the rat hole 316 at a particular depth is close to the circumference of the borehole 17 at that depth. Next, the casing 16 is secured within a slip. Next, the BHA 19 is disengaged from the lower latch apparatus 304, and removed from the borehole 17 via wireline or drillstring. Finally, the casing 16 is moved downwards such that the casing 16 surrounds the borehole 17 at the depth of the enlarged rat hole. As such, the integrity of the surrounding earth formation may be increased during the cementing process.

Figure 6:
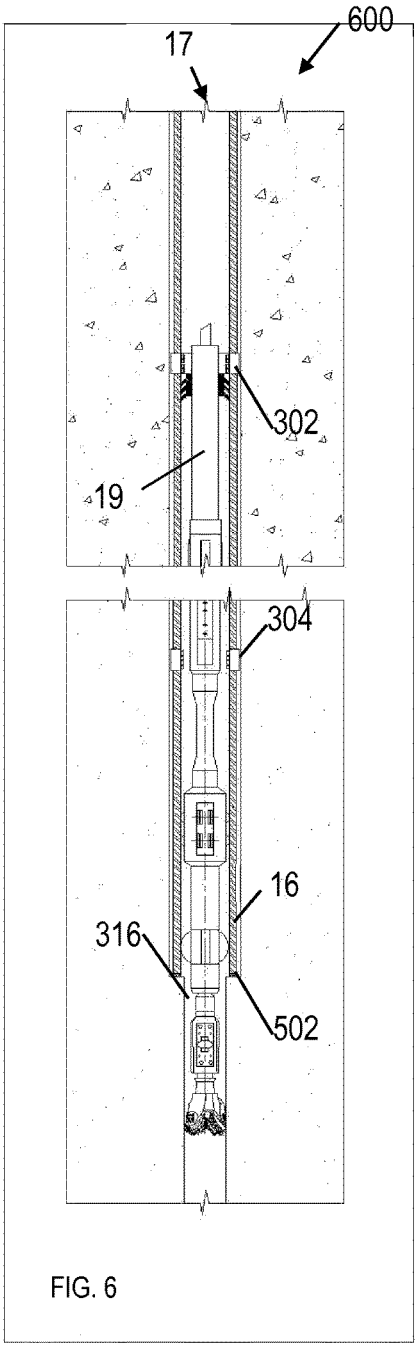
FIG. 6 is a cross-sectional view of an illustrative multi-position latchable CWD system showing drilling using casing bit.

Turning to FIG. 6, another alternative system 600 and method for enlarging a rat hole 316 using latching with casing and the casing bit are disclosed. First, the BHA 19 is repositioned within the casing 16 to the upper latch apparatus 302. Next, a casing bit 502 is used to enlarge the rat hole 316. The casing bit 502 is a special reamer located at the end of the casing 16. In at least one embodiment, the casing bit 502 includes mating threads on the bottom section of casing. By pushing the casing 16 downwards, and rotating if necessary, the casing bit 502 enlarges the rat hole 316. Such an embodiment is useful if a conventional reamer fails, is not available, or is too expensive to deploy. By repositioning the BHA 19 within the borehole 17, instead of removing the BHA 19 from the borehole 17, multiple trips may be avoided. Also, by enlarging the rat hole 316, the integrity of the surrounding earth formation may be increased during the cementing process.

Figure 7A:
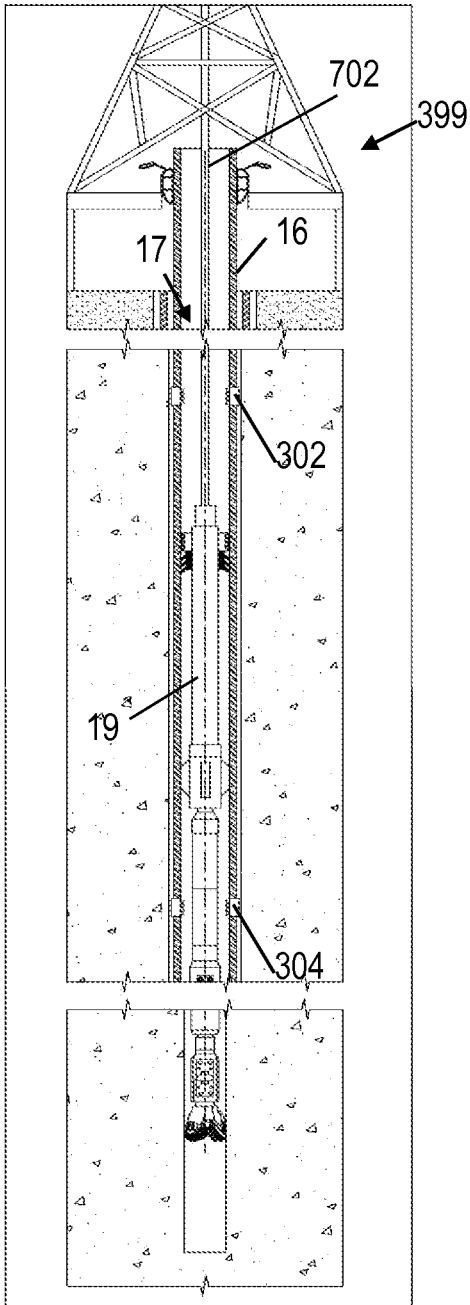
FIGS. 7A-7B are cross-sectional views of an illustrative multi-position latchable CWD system showing a wireline.
Figure 7B:
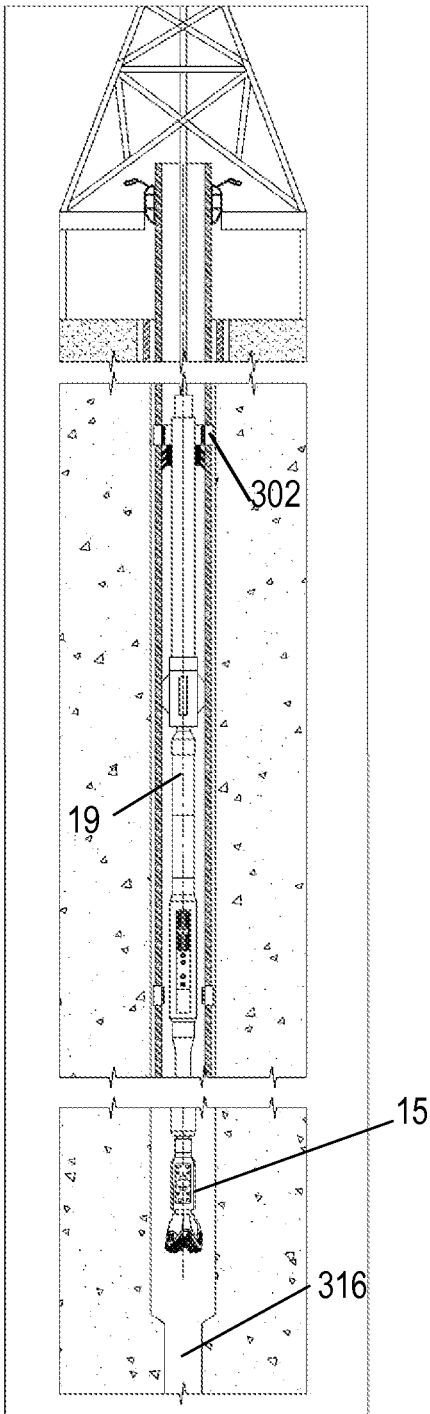
Figure 8A:
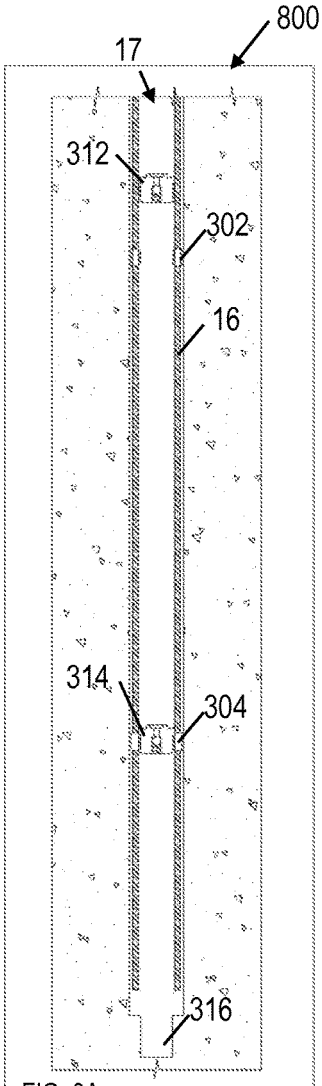
FIGS. 8A-8C are cross-sectional views of an illustrative multi-position latchable CWD system showing cementing.
Figure 8B:
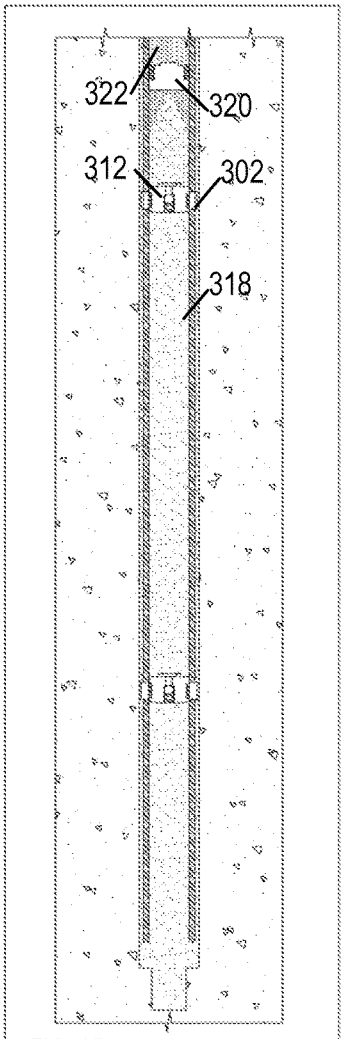
Figure 8C:
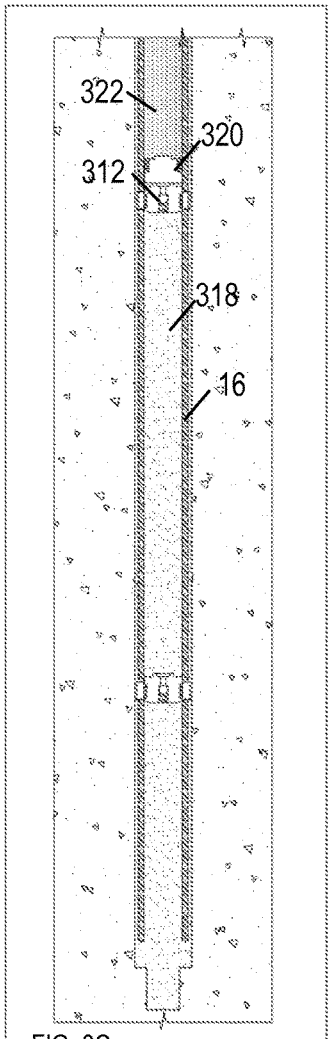

Turning to FIG. 7A, a system 700 and method for enlarging a rat hole using latching with casing and a wireline are disclosed. First, the casing 16 may be secured in a slip 399. Next, a wireline 702, or similar running tool, may be inserted into the borehole 17 to engage with the BHA 19. Next, the wireline 702 may be used to reposition the BHA 19, e.g., from the lower latch apparatus 304 to the upper latch apparatus 302. Next, turning to FIG. 7B, with the BHA 19 engaged with the upper latch apparatus 302, the reamer 15 (not extended) may be lowered toward the rat hole 316. Next, the reamer 15 may be extended, and the rat hole 316 may be enlarged by the reamer 15. After, the rat hole 316 has been enlarged, the BHA 19 may be removed from the borehole 17 and the cementing process may be performed, e.g. as illustrated in FIGS. 8A-8C, with the casing 16 at the depth of the previously un-enlarged rat hole. As such, the integrity of the surrounding earth formation may be increased during the cementing process.

Turning to FIG. 8A, a system 800 includes a lower latch apparatus 304 that includes a BHA latch landing (e.g. S1) and cement valve latch landing (e.g. S2). The system 800 also includes an upper latch apparatus 302 that includes a BHA latch landing (e.g. S1) and cement valve latch landing as well. In at least one embodiment, the cement valve latch landing in the upper apparatus 302 is different (e.g. S3) from the cement valve latch landing in the lower apparatus 304 (e.g. S2). In an alternative embodiment, both cement valve latch landings are the same (e.g. both are in the position of S2 on their respective latch apparatus). The borehole 17 includes a short section not enlarged, which is a hole 316 smaller in diameter than the borehole 17 located at the end of the borehole 17.

First, a cement valve 314 is inserted into the borehole 17. The cement valve bypasses the upper latch apparatus 302 by either not being rotated to engage the upper latch apparatus 302 or by not having any latches that are configured to engage the upper latch apparatus 302. Next, the cement valve 314 engages the lower latch apparatus 304. Next, another cement valve 312 is inserted into the borehole 17. Turning to FIG. 8B, the second cement valve 312 engages the upper latch apparatus 302. With both cement valves 312, 314 in place, cement 318 is inserted into the borehole 17. The valves allow the cement to flow only downhole through the valves. Next, drilling fluid 322 and a displacement plug 320 are inserted into the borehole 17. Turning to FIG. 8C, the displacement plug 320 lands on the upper cement valve 312. Should any cement 318 be contaminated, the contaminated cement will be contained inside the casing 16 where it will be eliminated during drilling. No contaminated cement will enter the annulus between the casing 16 and borehole 17.

A casing while drilling system includes a casing string including an upper latch apparatus and a lower latch apparatus. The system also includes a bottom hole assembly (BHA) latched into the lower latch apparatus for steerable drilling, the BHA configured to latch into the upper latch apparatus for enlarging a rat hole.

A majority of the BHA, when latched into the upper latch apparatus, may be surrounded by the casing string. The BHA may be repositioned either from the upper latch apparatus to the lower latch apparatus or from the lower latch apparatus to the upper latch apparatus both without exiting a borehole. The distance between the lower latch apparatus and the upper latch apparatus is not greater than the length of the BHA. The lower latch apparatus may include a lower BHA latch landing, and the upper latch apparatus may include an upper BHA latch landing. The lower latch apparatus may also include a lower cement valve latch landing, and the upper latch apparatus may also include an upper cement valve latch landing. A cement valve capable of latching into the lower latch apparatus is not capable of latching into the upper latch apparatus. A cement valve capable of latching into the upper latch apparatus is not capable of latching into the lower latch apparatus. In another embodiment, a cement valve capable of latching into the lower latch apparatus may be capable of latching into the upper latch apparatus.

A casing while drilling method includes assembling a casing string including an upper latch apparatus and a lower latch apparatus. The method also includes latching a steerable BHA into the lower latch apparatus. The method also includes steering the casing string along a trajectory to a total depth. The method also includes repositioning the BHA to latch into the upper latch apparatus. The method also includes enlarging a rat hole at or under the total depth.

Enlarging the rat hole may include using a casing bit coupled to the casing to enlarge the rat hole. Repositioning the BHA may include using a wireline to reposition the BHA from the lower latch apparatus to the upper latch apparatus. Repositioning the BHA may include resting the BHA within a borehole and moving the casing string relative to the resting BHA. Resting the BHA may include resting a reamer of the BHA on a top edge of the rat hole. Enlarging the rat hole may include using a reamer to enlarge the rat hole. The method may also include removing the BHA from a borehole and cementing the casing at the total depth.

A cementing method may include assembling a casing string including an upper latch apparatus and a lower latch apparatus. The method also includes positioning the casing string within a borehole. The method also includes latching a cement valve into the lower latch apparatus. The method also includes latching a second cement valve into the upper latch apparatus. The method also includes injecting cement through the casing string into an annulus.

The method may also include inserting a displacement plug, or cement float, into the borehole, the displacement plug configured to displace cement through the second cement valve.

A well prepared for cementing includes a casing string including an upper latch apparatus and a lower latch apparatus. The well also includes a cement valve latched into the lower latch apparatus. The well also includes a second cement valve latched into the upper latch apparatus.

The well may also include a displacement plug configured to displace cement through the second cement valve.

While the present disclosure has been described with respect to a limited number of embodiments, those skilled in the art will appreciate numerous modifications and variations therefrom. It is intended that the appended claims cover all such modifications and variations.

What is claimed is:

1. A casing while drilling system, comprising:

a casing string comprising:

an upper latch apparatus having a plurality of sets of latch landings, wherein each one of the plurality of sets of latch landings are configured to engage a different one of a plurality of downhole tools; and a lower latch apparatus having a plurality of sets of latch landings, wherein each one of the plurality of sets of latch landings are configured to engage a different one of a plurality of downhole tools; and a bottom hole assembly (BHA) latched into one of the plurality of sets of latch landings of the lower latch apparatus for steerable drilling, the BHA configured to latch into one of the plurality of sets of latch landings of the upper latch apparatus for enlarging a rat hole.

2. The system of claim 1, wherein a majority of the BHA, when latched into the upper latch apparatus, is surrounded by the casing string.

3. The system of claim 1, wherein the BHA can be repositioned either:

from the upper latch apparatus to the lower latch apparatus; or from the lower latch apparatus to the upper latch apparatus;

both without exiting a borehole.

4. The system of claim 1, wherein the distance between the lower latch apparatus and the upper latch apparatus is not greater than the length of the BHA.

5. The system of claim 1, wherein one of the plurality of sets of latch landings of the lower latch apparatus is a lower BHA latch landing, and wherein one of the plurality of sets of latch landings of the upper latch apparatus is an upper BHA latch landing.

6. The system of claim 5, wherein one of the plurality of sets of latch landings of the lower latch apparatus is a lower cement valve latch landing, and wherein one of the plurality of sets of latch landings of the upper latch apparatus is an upper cement valve latch landing.

7. The system of claim 1, wherein a first cement valve capable of latching into the lower latch apparatus is not capable of latching into the upper latch apparatus.

8. The system of claim 7, wherein a second cement valve capable of latching into the upper latch apparatus is not capable of latching into the lower latch apparatus.

9. The system of claim 1, wherein a cement valve capable of latching into the lower latch apparatus is capable of latching into the upper latch apparatus.

10. A casing while drilling method, comprising:

assembling a casing string comprising an upper latch apparatus and a lower latch apparatus wherein the upper latch apparatus and lower latch apparatus each include a plurality of sets of latch landings, wherein each one of the plurality of sets of latch landings are configured to engage a different one of a plurality of downhole tools;

latching a steerable bottom hole assembly (BHA) into one of the plurality of sets of latch landings of the lower latch apparatus;

steering the casing string along a trajectory to a total depth;

repositioning the BHA to latch into one of the plurality of sets of latch landings of the upper latch apparatus; and enlarging a rat hole at or under the total depth.

11. The method of claim 10, wherein enlarging the rat hole comprises using a casing bit coupled to the casing to enlarge the rat hole.

12. The method of claim 10, wherein repositioning the BHA comprises using a wireline to reposition the BHA from the lower latch apparatus to the upper latch apparatus.

13. The method of claim 10, wherein repositioning the BHA comprises resting the BHA within a borehole, and moving the casing string relative to the resting BHA.

14. The method of claim 13, wherein resting the BHA comprises resting a reamer of the BHA on a top edge of the rat hole.

15. The method of claim 10, wherein enlarging the rat hole comprises using a reamer to enlarge the rat hole.

16. The method of claim 10, further comprising:

removing the BHA from a borehole; and cementing the casing at the total depth.

17. A cementing method, comprising:

assembling a casing string comprising an upper latch apparatus and a lower latch apparatus wherein the upper latch apparatus and lower latch apparatus each include a plurality of sets of latch landings, wherein each one of the plurality of sets of latch landings are configured to engage a different one of a plurality of downhole tools;

positioning the casing string within a borehole;

latching a cement valve into one of the plurality of sets of latch landings of the lower latch apparatus;

latching a second cement valve into one of the plurality of sets of latch landings of the upper latch apparatus; and injecting cement through the casing string into an annulus.

18. The method of claim 17, further comprising inserting a displacement plug into the borehole, the displacement plug configured to displace cement through the second cement valve.

19. A well prepared for cementing, comprising:

a casing string comprising an upper latch apparatus and a lower latch apparatus, wherein the upper latch apparatus and lower latch apparatus each include a plurality of sets of latch landings, wherein each one of the plurality of sets of latch landings are configured to engage a different one of a plurality of downhole tools;

a cement valve latched into one of the plurality of sets of latch landings of the lower latch apparatus; and a second cement valve latched into one of the plurality of sets of latch landings of the upper latch apparatus.

20. The well of claim 19, further comprising a displacement plug configured to displace cement through the second cement valve.

* * * * *